US005697335A

United States Patent [19]

Kimura et al.

[11] Patent Number: 5,697,335

[45] Date of Patent: Dec. 16, 1997

[54] INDUCTION DEVICE FOR ENGINE

[75] Inventors: Sakayuki Kimura; Hiroshi Nakai, both of Hamamtatsu, Japan

[73] Assignee: Sanshin Kogyo Kabushiki Kaisha, Shizuoka, Japan

[21] Appl. No.: 639,026

[22] Filed: Apr. 16, 1996

[30] Foreign Application Priority Data

Apr. 17, 1995 [JP] Japan ..... 7-090554

[51] Int. Cl.[6] ..... B63H 21/26

[52] U.S. Cl. ..... 123/184.21

[58] Field of Search ..... 123/184.21, 184.35, 123/184.53, 184.43, 184.44, 184.36, 184.32, 196 R

[56] References Cited

U.S. PATENT DOCUMENTS

| | | | |
|---|---|---|---|
| 1,365,564 | 1/1921 | Strickland | 123/184.32 |
| 4,191,140 | 3/1980 | Matsumoto et al. | 123/184.53 |
| 4,465,035 | 8/1984 | Carr | 123/184.56 |
| 4,794,885 | 1/1989 | Honda et al. | 123/184.43 |
| 4,811,697 | 3/1989 | Kurahashi | 123/184.35 |
| 5,488,939 | 2/1996 | Nakai et al. . | |

*Primary Examiner*—Marguerite McMahon

*Attorney, Agent, or Firm*—Knobbe, Martens, Olson & Bear, LLP

[57] ABSTRACT

An engine of an outboard motor includes an improved induction system, including an intake silencer mounted to a plurality of induction pipes. The intake silencer includes a first and second expansion chamber separated by a wall. The wall includes an aperture for communicating the first and second expansion chambers. A filter element is provided for the aperture for preventing debris from entering the second expansion chamber and induction pipes. The induction pipes are integrally formed in an induction pipe casting. The induction pipe casting and air intake silencer deliver air to a carburetor assembly. The induction pipe casting and carburetor assembly are sealingly engaged through a seal plate and plurality of seals disposed between the induction pipe casting and carburetor assembly for providing an air-tight seal therebetween.

25 Claims, 5 Drawing Sheets

INDUCTION DEVICE FOR ENGINE

BACKGROUND OF THE INVENTION

The present invention relates generally to marine propulsion systems, and more particularly, to induction systems for marine propulsion systems.

A marine propulsion system, especially of the outboard motor type, typically employ an induction system for supplying air and fuel to the cylinders of an engine. It is important that the air and fuel flow through the induction system at a certain flow rate for optimizing engine performance. For this reason, it is desirable to make the induction system air tight by eliminating air and fuel leaks in the system. Air leaks typically occur at discontinuities in the induction system, such as the junction of the components of the induction system. The junction of the carburetors and the induction pipes is particularly prone to these air leaks.

A typical sealing arrangement between the carburetors and the induction pipes consists only of a carburetor flange directly mounted to a flange of the induction pipes. Another example of a sealing arrangement between the carburetors and the induction pipes consists of a gasket disposed between a carburetor flange and flange of the induction pipes. The gasket includes a hole corresponding in size to the openings of the induction pipes and carburetors that allow air to pass through. Although these sealing arrangements may provide an air-tight seal at first, movement of the carburetors and induction pipes caused by thermal expansion and contraction and vibrations from the engine and outboard motor may cause air leaks to form at this junction.

It is therefore one of the principal objects of the present invention to provide a sealing arrangement for an induction system of an outboard motor engine that sealingly engages the junction of the carburetors and induction pipes to provide an air-tight seal.

Induction systems of the past typically include an air intake silencer which draws air into the induction system from the interior of a cowling of an outboard motor. It is important that the air drawn into the induction system be free from dirt, dust and other debris because the air is eventually delivered to the engine. Dirt and other debris drawn into the engine may act to grind away machined engine parts to a rough finish so as to require complete engine reconditioning. Thus, some induction systems of the past included filters for preventing dust and debris drawn into the silencer from entering the intake pipes.

One such induction system includes an air intake silencer separated into a first and second expansion chamber by a wall. The wall includes an aperture for communicating the first and second expansion chambers. The expansion chambers are designed for mixing, diffusing and evenly distributing blow-by gases and air to prevent engine knock caused by some combustion chambers receiving a richer air and fuel mixture than others. The air intake silencer is mounted to a plurality of induction pipes for delivering the air to a plurality of carburetors. A filter is provided between the second expansion chamber and induction pipes for preventing dirt and debris from entering the induction pipes and engine.

Although this filter arrangement advantageously prevents dirt and debris from entering the engine, dirt and debris may permanently collect within the second expansion chamber.

It is therefore another principal object of the present invention to provide an induction system of an outboard motor engine having a filter arrangement in an air intake silencer with a first and second expansion chamber that not only prevents dirt and debris from entering the induction pipes but prevents dirt and debris from permanently collecting in the intake silencer.

SUMMARY OF THE INVENTION

A need therefore exists for an improved induction system for an engine of an outboard motor having the induction pipes sealingly engaged to the carburetors for providing an air-tight seal in the induction system and a filter arrangement in an air intake silencer that prevents debris from entering the induction pipes and permanently collecting in the intake silencer.

In accordance with an aspect of the present invention, an induction system for an internal combustion engine of an outboard motor is provided. The induction system comprises a plurality of carburetors for delivering an air and fuel charge to a plurality of combustion chambers within an engine. An air intake silencer is mounted to a plurality of induction pipes for delivering air to the carburetors. The plurality of induction pipes form a corresponding plurality of intake passages and form an induction pipe casting. The induction pipe casting terminates at an outlet end. The outlet end of the induction pipe casting is sealingly engaged to the carburetors through a seal plate and plurality of seals disposed between the induction system outlet end and the carburetors for providing an air-tight seal in the induction system.

In accordance with another aspect of the present invention, an induction system for an internal combustion engine of an outboard motor comprises an air intake silencer mounted to a plurality of induction pipes for delivering air to a carburetor. The air intake silencer includes a first and second expansion chamber separated by a wall. The wall includes an aperture for communicating the first expansion chamber with the second expansion chamber. A filter is provided for the aperture for preventing debris from entering the second expansion chamber and intake pipes. The screen is positioned so that upon stopping the air flow through the induction system, the debris collected from the filter will fall out of the intake silencer.

DETAILED DESCRIPTION OF THE PREFERRED EMBODIMENTS OF THE INVENTION

Figure 1:
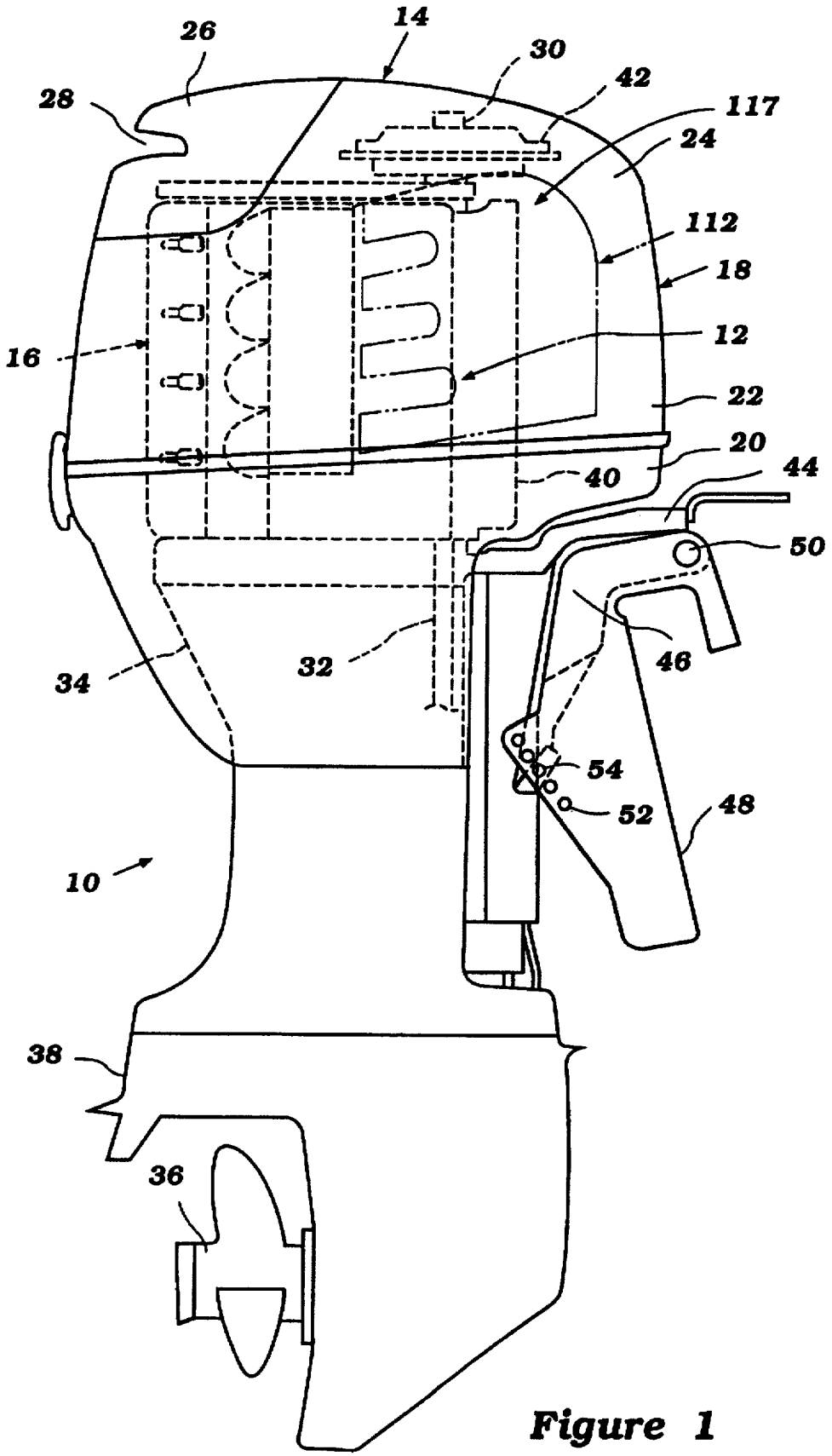
FIG. 1 is a side elevational view of a marine outboard motor which incorporates an induction system in accordance with a preferred embodiment of the present invention.

FIG. 1 illustrates a marine outboard, motor 10 which incorporates an induction system 12 configured in accordance with a preferred embodiment of the present invention. It is contemplated, however, that those skilled in the art will readily appreciate that the present improved induction system 12 can be applied to an engine of an inboard/outboard drive of a watercraft, as well.

In the embodiment illustrated in FIG. 1, the outboard motor 10 has a powerhead 14 which includes an internal combustion engine 16. A protective cowling assembly 18 of a known type surrounds the engine 16. The cowling assembly 18 includes a lower tray portion 20 and a top cover portion 22. The cowling defines an engine compartment 24 which houses the engine 16.

Figure 2:
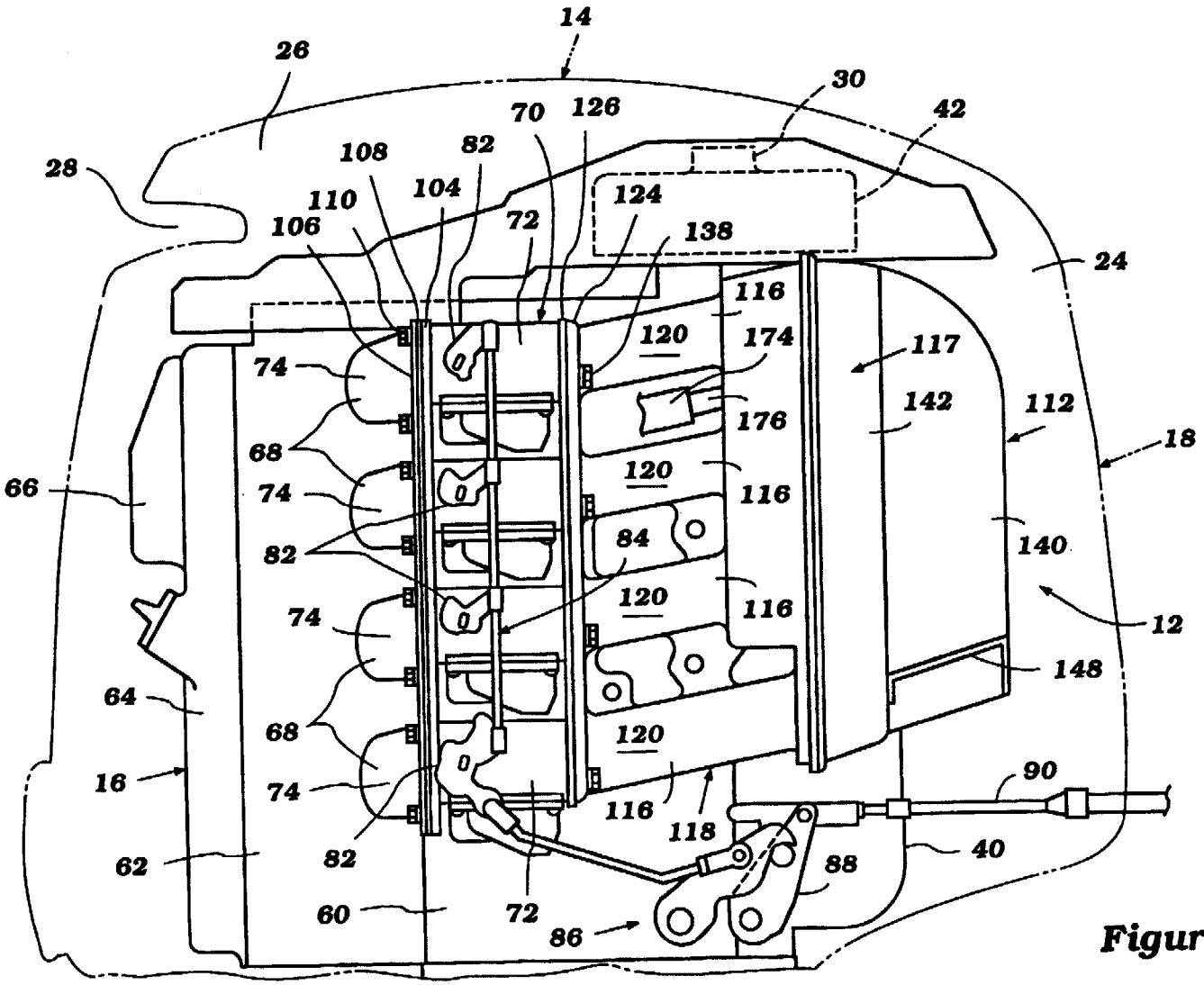
FIG. 2 is an enlarged, cut-away, side elevational view of a powerhead of the marine outboard motor of FIG. 1.

Referring to FIGS. 1 and 2, a handle insert 26 is affixed to the top of the cowling 18 and includes an inlet opening 28 to allow ambient air to flow inside the handle insert 26 and into the engine compartment 24. The handle insert 26 also includes a baffle (not shown) disposed within the handle insert 26 to inhibit water flow into the engine compartment 24. As known in the art, the configuration of opening 28 provides an effective drain for the water removed from the influent air flow by the baffle and functions as a handle for raising and lowering the outboard motor 10.

The engine 16 illustrated is a four-stroke, in-line four-cylinder internal compression engine. It is understood, however, that the present induction system 12 can be employed with engines having other numbers of cylinders, having other cylinder orientations, and/or operating on other than a four-stroke principle.

The engine 16 has a crankshaft 30 that drives a drive shaft 32 journaled for rotation within a drive shaft housing 34 and which drives a propeller 36 of a lower unit 38 through a conventional forward, neutral, reverse transmission (not shown). The crankshaft 30 is suitably journaled for rotation within a crankcase 40 and a standard magneto flywheel assembly 42 is attached to the upper end of the crankshaft 30.

A steering shaft (not shown) is affixed to a steering bracket 44 which is attached to the drive shaft housing 34 and is journaled within a swivel brisket 46 for steering of the outboard motor 10 about a generally vertically extending steering axis. The swivel bracket 46 is, in turn, connected for pivotal movement to a clamp bracket 48 by means of a tilt shaft 50 for tilt and trim adjustment of the outboard motor 10. The clamp bracket 48 includes a series of trim apertures 52 extending laterally therethrough for receiving a stop pin 54 which is engageable with the swivel bracket 46.

Although not illustrated, it is understood that a conventional hydraulic tilt and trim cylinder assembly, as well as a conventional hydraulic steering cylinder assembly, could be used as well with the present outboard motor 10. It is also understood that the above description of the construction of the outboard motor 10 is conventional, and thus, further details of the steering, trim and mounting assemblies are not necessary for an understanding of the present invention.

Referring to FIG. 2, the engine includes a cylinder block 60 which in the, illustrated embodiment defines four aligned cylinder bores (not shown). Pistons (not shown) reciprocate within the cylinder bores, and connecting rods (not shown) link the pistons and the crankshaft 30 together so that the reciprocal linear movement of the pistons rotates the crankshaft 30 in a known manner. The crankcase 40, attached to the cylinder block 60 by known means, surrounds at least a portion of the crankshaft 30.

On the opposite end of the cylinder block 60, a cylinder head 62 is attached. The cylinder-bores, heads of the pistons and cylinder head 62 form corresponding combustion chambers (not shown). The cylinder head 62 has a construction that is known in the art. The cylinder head 62 supports and houses a plurality of intake and exhaust valves (not shown), as well as intake and exhaust camshafts (not shown) which operate the valves. A camshaft cover 64, attached to the cylinder head 62, encloses the intake and exhaust camshafts within the cylinder head 62.

The engine 16 also includes a lubrication system (not individually shown) which circulates the lubricant between the crankcase 40 and the cylinder head 62. Blow-by gases pass through piston rings surrounding the pistons into the crankcase 40. The blow-by gases ventilate the lubricant in the crankcase and are removed to the cylinder head 62 and blow-by gas ventilation chamber 66. The blow-by gas ventilation chamber is attached to the camshaft cover 64 and communicates with the interior of the cylinder head 62. The blow-by gases contain lubricant from ventilating the lubricant in the crankcase 40. Because of this, the chamber 66 houses a conventional baffling device (not shown) which is used to separate the lubricant form the blow-by gases. The chamber also includes an effluent port (not shown) for venting the blow-by gases from the ventilation chamber 66 to the induction system 12, as discussed below.

The induction system of the present invention includes an intake manifold 68 having a plurality of intake pipes 74 and is interposed between a carburetor assembly 70 and the cylinder head 62. The carburetor assembly 70 includes a plurality of vertically aligned carburetors 72 connected to the intake manflold 68. The intake manifold 68 desirably is integrally formed with the cylinder head 62 communicates with each cylinder bore via valve ducts (not shown) in the cylinder head 62, thus placing each carburetor 72 in communication with one of the cylinder bores of the cylinder block 60. In this manner, as known in the art, the carburetors 72 supply a fuel and air mixture to the engine.

Each carburetor 72 is desirably aligned with an intake pipe 74 of the intake manifold. It is also understood that even though the four carburetors 72 are illustrated in the preferred embodiment, the present induction system 12 can be used with any number of carburetors 72.

Referring to FIG. 2, as is well known in the art, each of the carburetors include a throttle valve 80 (See FIG. 4) for controlling the amount of air and fuel change delivered to the combustion chambers. The throttle valves are controlled by respective throttle levers 82. The throttle levers 82 are interconnected by an interlocking rod 84 for simultaneous movement of the throttle levers 82. The throttle levers 82 are controlled by a throttle operator 86, which is operated on by a link mechanism 88 for control of the throttle valves 80. A wire 90 couples the link mechanism 88 to an accelerator (not shown) for control of the throttle valves 80.

Figure 4:
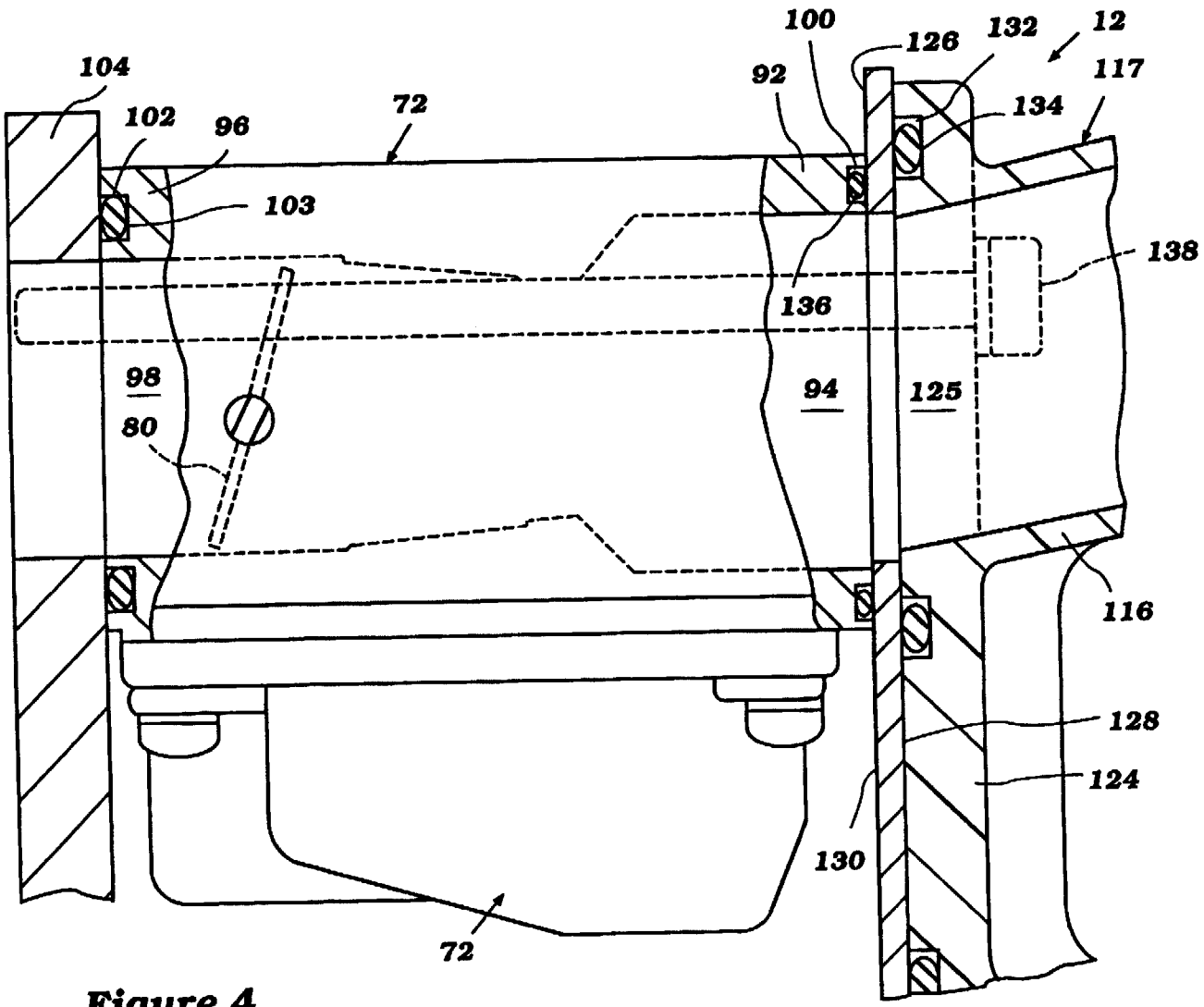
FIG. 4 is an enlarged, cut-away side elevational view of the junction of one, the induction pipes and carburetors of the induction system of the present invention.

Referring to FIG. 4, each carburetor 72 includes an inlet side 92 and opening 94 and an outlet side 96 and opening 98. Furthermore, each carburetor 72 includes a generally circular groove 100 in the inlet side 92 and a generally circular groove 102 in the outlet side 96. An o-ring 103 is provided in circular groove 102 to sealingly engage the outlet side 96 of the carburetor 72 with an aluminum alloy support plate 104. The support plate 104 is attached to a flange 106 of the intake manifold 68 through an insulator member 108 and a (See FIG. 2) a plurality of threaded fasteners 110. The insulator member 108 elastically bonds the flange 106 of the intake manifold 68 to the support plate 104 to thermally and vibrationally decouple the carburetor 72 from the cylinder head 62.

Figure 3:
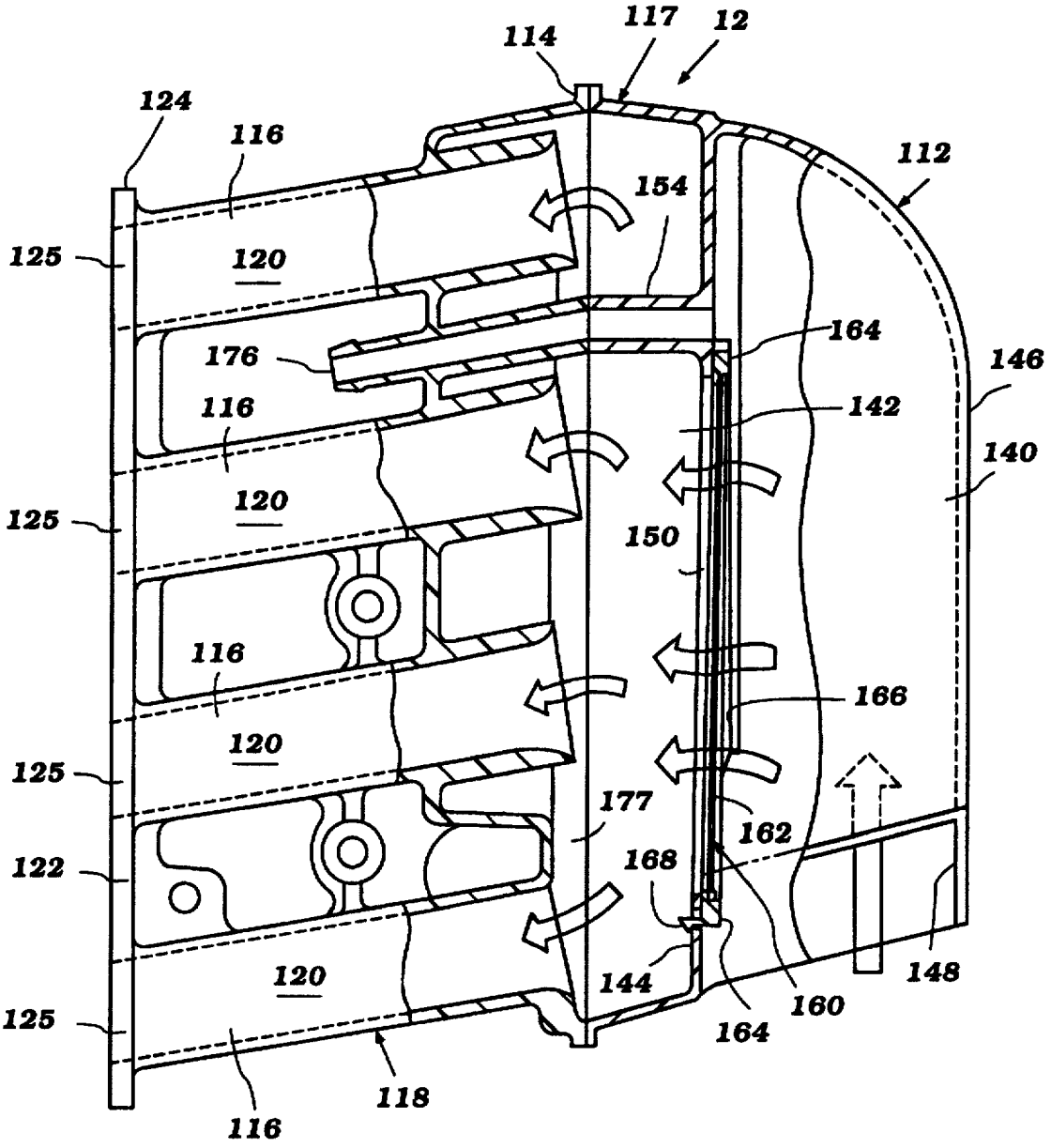
FIG. 3 is an enlarged, cut-away side elevational view of the air silencer and induction pipe casting of the induction system of the present invention.
Figure 5:
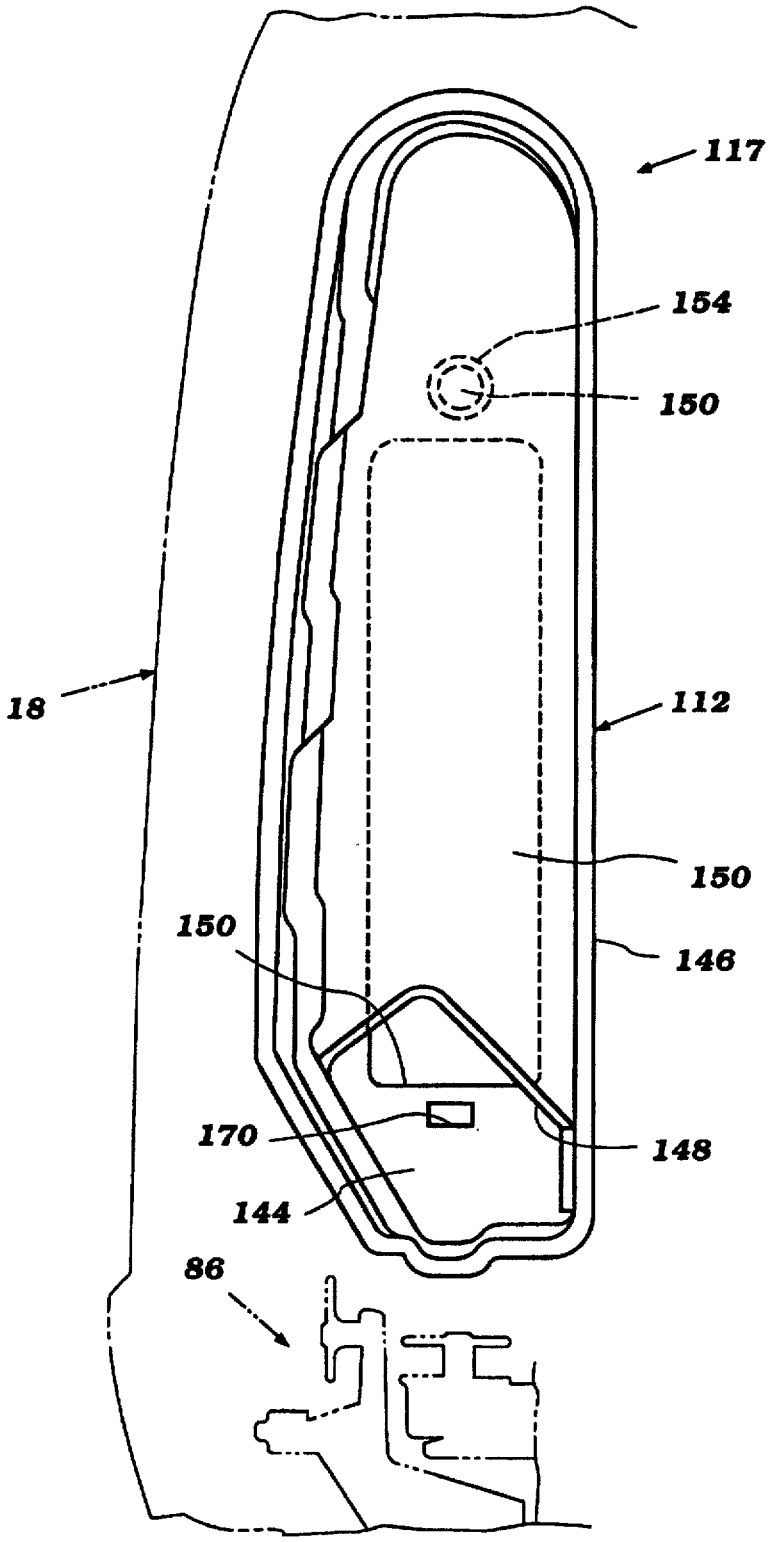
FIG. 5 is an enlarged, cut-away plan view of the air silencer of the induction system of the present invention.

Referring to FIGS. 3 through 5, and described in more detail below, the induction system 12 further includes an air intake silencer, or air intake device, 112 mounted to a plurality of induction pipes 116 through a weld 114. The induction pipes 116 integrally form a single cam assembly 118 ("induction pipe casting") and define a plurality of induction or intake passages 120. The induction pipe casting terminates at an outlet end 122 to form a flange 124 and a plurality of outlet openings 125.

Referring specifically to FIG. 4, a seal plate 126 is disposed between flange 124 and carburetor inlet side 92. Seal plate 126 is a flat metal plate. The seal plate 126 has a first side 128 facing flange 124 and a second side 130 facing outlet side 92. Flange 124 includes a circular groove 132 in which an O-ring 134 is disposed for sealingly engaging the first side 128 of the seal plate 126. An O-ring 136 is disposed in circular groove 100 of the inlet side 92 of carburetor 72 for sealingly engaging the second side 130 of seal plate 126. A plurality of bolts 138 mount the above-described sealing arrangement together. The above-described sealing arrangement provides an air-tight seal for the induction passages 120. By separately sealingly engaging both sides 128 and 130 of the seal plate 126, the sealing arrangement is configured to allow for thermal expansion and shifting of the carburetors 72 and induction pipe casting 118 while retaining an air-tight sealing engagement between the carburetors 72 and casting 118. Seal plate 126 includes a hole corresponding in size and aligned with the induction pipes 116.

The intake silencer 112 draws ambient air into the engine 16 from the interior of the cowling 18. The induction pipes 116 deliver air through the intake passages 120 from the intake silencer 112 to the carburetors 72. The lengths of the pipes 116 are desirably tuned with the silencer 112 to minimize the noise produced by the induction system 12, as is known in the art. The intake silencer 112 and induction pipe casting 118 are constructed of plastic for reducing the weight of the motor 10 and reducing thermal expansion.

The intake silencer 112 includes a first expansion chamber 140 and a second expansion chamber 142 which are separated by a wall 144 within a housing 146 of the silencer 112. The first expansion chamber 140 desirably has a volume larger than the volume of the second expansion chamber 142, and more preferably has a volume at least twice as large as that of the second expansion chamber 142, for the reasons explained below.

The silencer housing 146 includes an air inlet 148 for drawing air into the silencer 112 positioned at the bottom of the housing 146 and facing in the downward direction. This configuration and orientation generally prevents any water, which enters the engine compartment 24 through the inlet opening 28 in the cowling assembly 18, from being drawn into the engine 16. The inlet 148 opens into the first expansion chamber 140 of the silencer 112.

The first expansion chamber 140 communicates with the second expansion chamber 142 through an aperture 150 in the wall. The aperture 150 is desirably distanced from the inlet 148 to prevent ambient air from flowing directly into the second expansion chamber 142, without the air first flowing through at least a portion of the first expansion chamber 140. In the illustrated embodiment, the aperture 150 is positioned about at the middle of the wall 144, as viewed in the vertical direction, as shown in FIG. 5. The second expansion chamber 142 in turn communicates with the induction pipes 116, as discussed below.

The wall also defines a second aperture 150 that opens into a horizontally extending tubular extension 154. The tubular extension 154 desirably has a length generally equal to the depth of the second expansion chamber 142.

A filter 160 is vertically aligned above inlet 148 and is disposed adjacent wall 144 on the first expansion chamber side to inhibit objects from entering the second expansion chamber 142 and the induction pipes 116. Referring to FIGS. 3 and 5, the filter 160 is configured to cover the aperture 150 that connects the first and second expansion chambers 140 and 142. The filter 160 comprises a filter membrane 162 and includes an outer support 164. The filter 160 is contained within a groove 166 in the housing 146 of the silencer 112. The filter 160 includes a stopper extension 168 that extends through a hole 170 in the wall 144 which, in conjunction with the groove 166, releasably engages the filter element 160 to the housing 146. The filter membrane 162 is comprised of a fine metal or plastic wire mesh formed by a plurality of crossing wires, but it is understood that other types of membranes, for example, foam, paper, etc., can be used as well. Objects are prevented from entering aperture 152 because air is forced through the tubular extension 154 and into the first expansion chamber, as described below.

By providing filter 160 between the first and second expansion chambers 140 and 142, debris is prevented from entering the second expansion chamber 142, induction passages 120 and engine 16. Additionally, by providing the filter 160 vertically aligned over inlet 148, when the outboard motor 10 is not running, air flow through the induction system stops and debris will fall from the filter 160 out of the first expansion chamber through the inlet 148.

A blow-by gas ventilation system is incorporated into the induction system 12 and includes and blow-by gas chamber 66 connected at the effluent port with the first expansion chamber 140 through a blow-by gas leading hose 174. For this purpose, the induction pipe casting 118 defines a tubular extension 176 which is aligned with tubular extension 154, and extends from an inlet side 177 of the induction pipe casting 118 to the blow-by gas leading hose 174. The hose 174 connects the effluent port of the blow-by gas chamber 66 to the tubular extension 176 of the induction pipe casting 118. Hose clamps or other conventional means (not shown) secure the hose 174 to the effluent port and the tubular extension 176 of the induction pipe casting 118.

In operation, the blow-by gas chamber 66 separates blow-by gases from the lubricant. Because of the resultant negative pressure within the silencer 112 caused by air flow therethrough, the blow-by gases flow through the effluent port of the chamber 66, through the hose 174, tubular extensions 176 and 154, and into the first expansion chamber 140.

Referring to FIG. 3, the blow-by gas is introduced into the first expansion chamber 140 at a location distanced from the inlet 148 of the intake silencer 112 to minimize the risk of the blow-by gases escaping to the atmosphere. The blow-by gases diffuse in the first expansion chamber 140 as they mix with ambient air drawn into the first expansion chamber 140 through the inlet 140 in the silencer housing 146. The first expansion chamber 140 desirably has a sufficiently large size to foster diffusion of the blow-by gases.

The mixture of blow-by gases and ambient air ("air mixture") flows from the first expansion chamber 140 into the second expansion chamber 142, through aperture 150 and filter element 160, where the air mixture distributes substantially uniformly across the openings of the induction pipes 116. Any debris in this air mixture will be caught by the filter 160 and will drop out of the first expansion chamber 140 through air inlet 140 when the engine 16 is stopped. Thus, debris is prevented from permanently entering the second expansion chamber 142. The pressure within the second expansion chamber 142 is generally uniform across the inlets 177 of each induction pipe 116. Consequently, the air mixture is distributed almost equally to each cylinder.

The second expansion chamber 142 is substantially smaller in size than the first expansion chamber 140 because the diffusion of the blow-by gas in the ambient air has already occurred in the larger first expansion chamber 140.

A large volumetric size for mixing purposes is not required. The even distribution of the air mixture across the inlets 177 of the induction pipes 116 provides for a more uniform distribution of the blow-by gases to the cylinders, and consequently, engine performance improves.

Of course, the foregoing description is that of preferred embodiments of the invention, and various changes and modifications may be made without departing from the spirit and scope of the invention, as defined by the appended claims.

What is claimed is:

1. An engine including an induction system comprising a plurality of carburetors for delivering an air and fuel charge to the engine, each of said carburetors having an inlet end and an outlet end, an air intake device including an expansion chamber, an atmospheric air inlet for delivering atmospheric air to said expansion chamber, a plurality of induction pipes forming a plurality of induction passages with said carburetors for delivering air from said intake device to said carburetors, each of said induction pipes having an inlet end and an outlet end, said outlet ends of said induction pipes sealingly engaged with the inlet ends of said carburetors by a single seal plate and a plurality of deformable sealing members each disposed between a respective side of said seal plate and a respective one of said induction pipes and said carburetor inlet ends and positioned to encircle a respective one of either the inlet end of the corresponding carburetor and the outlet end of the corresponding induction pipe.

2. The engine of claim 1, wherein said seal plate includes a flat metal plate having sides provided between the outlet ends of said induction pipes and the inlet ends of said carburetors, each outlet end of said induction pipes includes a groove in which one of said plurality of deformable sealing members is disposed for sealingly engaging each outlet end with one side of the seal plate.

3. The engine of claim 1, wherein each of the inlet ends of said carburetors include a groove in which one of said plurality of deformable sealing members is disposed for sealingly engaging the inlet ends with the other side of the seal plate.

4. The engine of claim 3, wherein said grooves are circular grooves and said deformable sealing members are O-rings.

5. The engine of claim 4, wherein each outlet end of said induction pipes forms an outlet opening, each inlet end of said carburetors forms an inlet opening, and said seal plate includes a plurality of holes corresponding in size to said outlet and inlet openings for communicating air from said induction pipes to said carburetors.

6. The engine of claim 5, wherein said induction pipes and said seal plate are fastened to said carburetors by a plurality of threaded fasteners.

7. The engine of claim 6, wherein said air intake device and said induction pipes are constructed of plastic.

8. The engine of claim 1, wherein said air intake device includes first and second expansion chambers separated by a wall, said wall includes an aperture for connecting together said expansion chambers, and a filter extends across said aperture for preventing debris from entering said second expansion chamber.

9. The engine of claim 8, wherein said filter is vertically aligned above said air inlet so that debris fails out of said air intake device through said air inlet when said engine is not running.

10. The engine of claim 9, wherein said filter is provided adjacent said aperture on a first expansion chamber side of said wall.

11. The engine of claim 10, wherein said air intake device includes a housing divided by said wall to form said first and second expansion chambers, said housing including a groove, and said filter is slidably contained within said groove.

12. The engine of claim 10, wherein said filter including a stopper extension, said wall including a hole, and said filter is releasably engaged within said hole through said stopper extension.

13. The engine of claim 1, wherein the plurality of deformable sealing members are independent of one another.

14. An engine including an induction system comprising a plurality of charge formers for delivering an air and fuel charge to the engine, an air intake device connected to a plurality of induction pipes forming a plurality of induction passages that communicate with said charge formers for delivering air to said charge formers, said air intake device including a first expansion chamber, an atmospheric air inlet for delivering atmospheric air to said first expansion chamber, and a second expansion chamber, said first and second expansion chambers separated by a wall, said wall including an aperture connecting together said first and second expansion chambers, and a filter at least coextensive to the aperture and arranged relative to the aperture to prevent debris from entering said second expansion chamber.

15. The engine of claim 14, wherein said filter is vertically aligned above said air inlet so that debris falls out of said air intake device through said air inlet when said engine is not running.

16. The engine of claim 15, wherein said filter is provided adjacent said aperture on a first expansion chamber side of said wall.

17. The engine of claim 16, wherein said air intake device includes a housing divided by said wall to form said first and second expansion chambers, said housing including a groove, and said filter is slidably contained within said groove.

18. The engine of claim 16, wherein said filter including a stopper extension, said wall including a hole, and said filter is releasably engaged within said hole through said stopper extension.

19. The engine of claim 18, wherein said air intake device and said induction pipes are constructed of plastic.

20. An engine including an induction system comprising a plurality of induction pipes which communicate with at least a plurality of charge formers, a common mounting plate being interposed between the charge formers and the induction pipes and including a plurality of openings, each opening located to place one of the inductions pipes in communication with a respective charge former, and means for sealing the interface between each charge former and the mounting plate.

21. An engine as in claim 20 additionally comprising means for sealing the interface between each induction pipe and the mounting plate.

22. An engine as in claim 20, wherein said plurality of induction pipes is equal in number to the number of charge formers of the induction system.

23. An engine as in claim 20, wherein the induction pipes form an integral structure with each induction pipe terminating at a common flange that abuts the mounting plate.

24. An engine as in claim 23 additionally comprising means for sealing the interface between the common flange and the mounting plate about an end of each induction pipe.

25. An engine as in claim 20, wherein at least one charge former is a carburetor.

* * * * *